US008474252B2

(12) United States Patent
Butler

(10) Patent No.: US 8,474,252 B2
(45) Date of Patent: Jul. 2, 2013

(54) OVAL-TO-ROUND EXHAUST COLLECTOR SYSTEM

(76) Inventor: Boyd L. Butler, Sandy, UT (US)

( * ) Notice: Subject to any disclaimer, the term of this patent is extended or adjusted under 35 U.S.C. 154(b) by 560 days.

(21) Appl. No.: 12/649,093

(22) Filed: Dec. 29, 2009

(65) Prior Publication Data

US 2011/0154812 A1 Jun. 30, 2011

(51) Int. Cl.
*F01N 1/00* (2006.01)

(52) U.S. Cl.
USPC ..... 60/323; 60/305; 60/312; 60/313; 60/322

(58) Field of Classification Search
USPC ..... 60/272, 305, 312, 313, 314, 322, 60/323, 324
See application file for complete search history.

(56) References Cited

U.S. PATENT DOCUMENTS

| | | | | |
|---|---|---|---|---|
| 3,491,534 | A | 1/1970 | Garner | |
| 3,507,301 | A * | 4/1970 | Larson | 137/602 |
| 4,796,426 | A * | 1/1989 | Feuling | 60/313 |
| 4,800,719 | A * | 1/1989 | Campbell | 60/313 |
| 5,216,883 | A * | 6/1993 | Flugger | 60/313 |
| 5,269,650 | A | 12/1993 | Benson | |
| 5,471,835 | A | 12/1995 | Friedman | |
| 5,595,062 | A | 1/1997 | Chabry | |
| 5,727,386 | A | 3/1998 | Watanabe et al. | |
| 5,740,671 | A | 4/1998 | Jones | |
| 5,768,891 | A | 6/1998 | Wagner | |
| 5,787,709 | A | 8/1998 | Watanabe et al. | |
| 6,027,146 | A | 2/2000 | Kurimoto | |
| 6,199,376 | B1 * | 3/2001 | Maeda | 60/323 |
| 6,205,778 | B1 | 3/2001 | Akaba et al. | |
| 6,263,669 | B1 | 7/2001 | Kim | |
| 6,381,956 | B1 | 5/2002 | Gilbertson | |
| 6,463,641 | B2 | 10/2002 | Bassani | |
| 6,478,340 | B1 * | 11/2002 | Butler | 285/131.1 |
| 6,634,171 | B1 | 10/2003 | Banks, III | |
| 6,725,655 | B2 * | 4/2004 | Yoshirawa et al. | 60/323 |
| 6,742,332 | B2 | 6/2004 | Piekarski | |
| 8,196,703 | B2 * | 6/2012 | Stanley | 181/268 |

OTHER PUBLICATIONS www.stainlessworks.net; 2 Way Collector Catalog, 2 pages. downloaded Sep. 22, 2009.
www.spdexhaust.com; Merge Collectors Catalog, 10 pages. downloaded Sep. 22, 2009.
www.spdexhaust.com; Formed Collectors Catalog, 2 pages. downloaded Sep. 22, 2009.
burnsstainless.com; Burns Stainless 2009 catalog, 36 pages. downloaded Sep. 22, 2009.

* cited by examiner

*Primary Examiner* — Binh Q Tran
(74) *Attorney, Agent, or Firm* — Thorpe North & Western LLP

(57) ABSTRACT

An exhaust collector system for discharging a flow of exhaust gases from an internal combustion engine. The exhaust collector system includes a plurality of primary headers having their discharge portions merged together at a merge angle into a substantially oval or obround-shaped manifold outlet, and a substantially-round secondary pipe having a pipe inlet with a diameter greater than the diameter of the primary headers. The exhaust collector system also includes an oval-to-round collector flowtube which has a substantially oval-or obround-shaped collector inlet that is coupled with the manifold outlet and a substantially-round collector outlet that is coupled with the pipe inlet. The collector flowtube has a constant circumference along its entire length and a transverse cross-sectional area that continuously increases from the collector inlet to the collector outlet to cause a continuous expansion of the flow of exhaust gases.

21 Claims, 7 Drawing Sheets

Section A-A

Section B-B

Section C-C

Section D-D

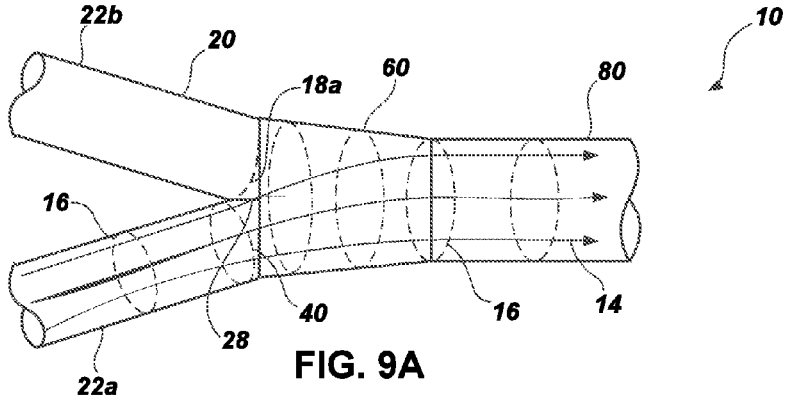
FIG. 9A
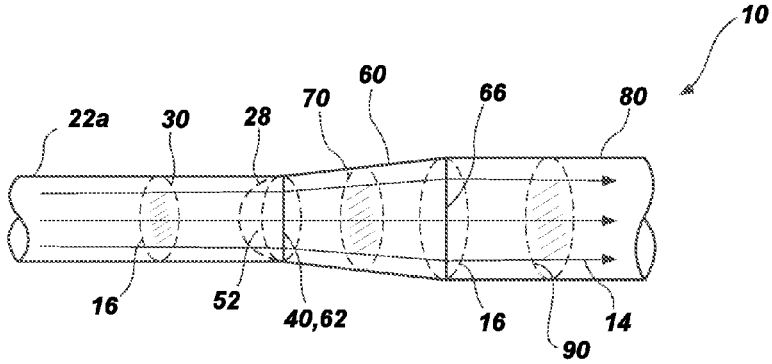
FIG. 9B
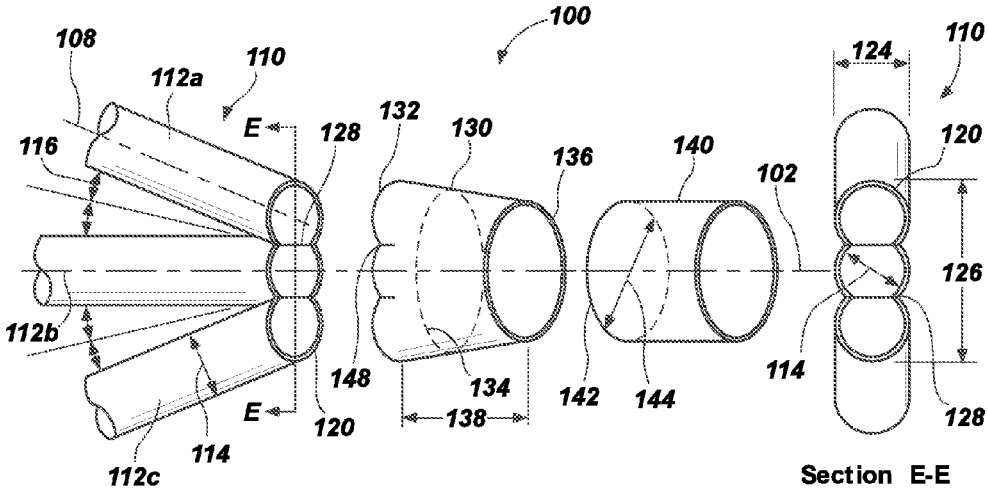
FIG. 10
FIG. 11

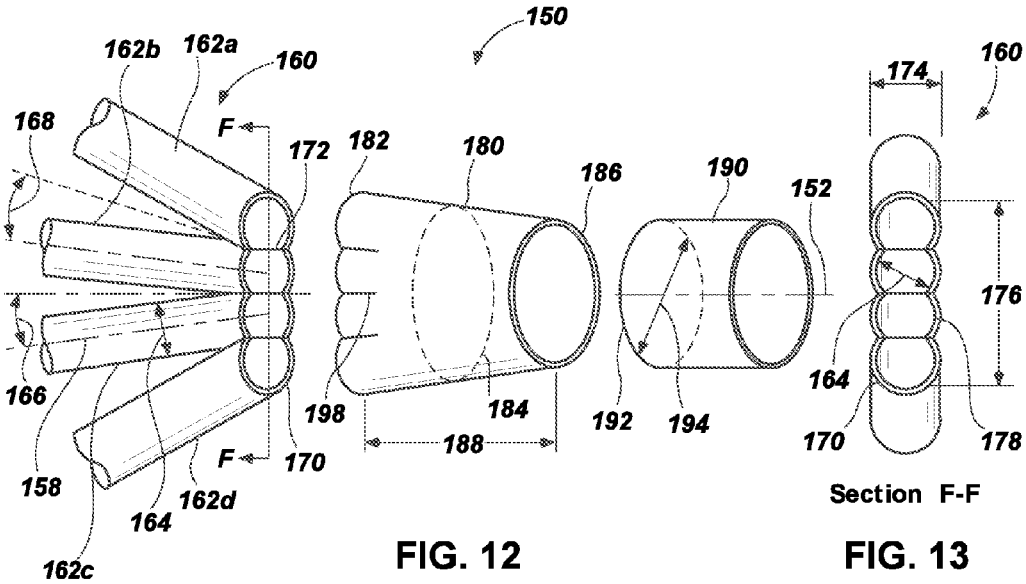
FIG. 12
FIG. 13
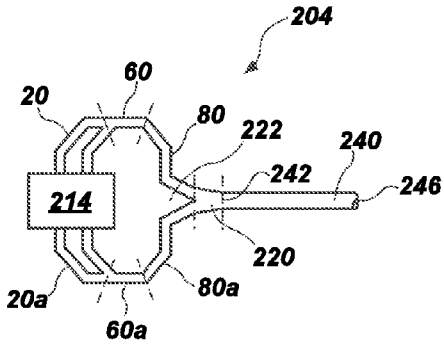
FIG. 14A
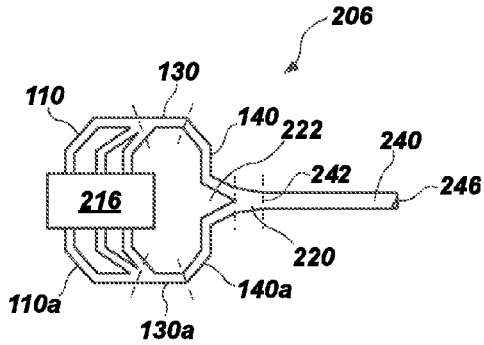
FIG. 14B
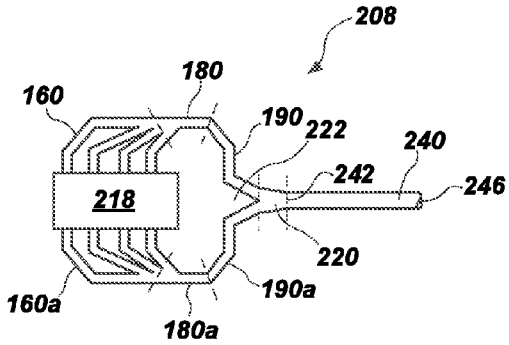
FIG. 14C

OVAL-TO-ROUND EXHAUST COLLECTOR SYSTEM

FIELD OF THE INVENTION

The field of the invention relates generally to exhaust systems for internal combustion engines, and more specifically to high-performance internal combustion engines of the type used on racing motor vehicles and light airplanes.

BACKGROUND OF THE INVENTION AND RELATED ART

Exhaust systems for high-performance internal combustion engines of the type used on racing vehicles have been the subject of empirical design work and theoretical studies. One area of focus is the reflection of pressure waves at a change in the cross-sectional area of the exhaust system piping, such as found at the merge location where two or more primary header pipes are combined into a secondary header pipe. It has been discovered that pressure wave reflections can be applied in a manner that enhances engine performance. For instance, exhaust pulses from the engine can be reflected cyclically back to the engine exhaust port of the same or of an adjacent power cylinder as an expansion or rarefaction wave, so that for a portion of each cycle the exhaust pulse can assist with scavenging of the exhaust of the engine cylinder to increase the horsepower output of the engine.

Timing or "tuning" the reflected pressure waves to reach the exhaust port at the right moment, however, can be particularly difficult. This is because the propagation speed of the pressure pulse varies significantly with the temperature and composition of the media or gas through which it travels, which is difficult to determine in an exhaust system, and because the exhaust headers are not filled with a homogeneous density or pressure of gas. Thus, calculations usually are based upon a plurality of assumptions or approximations which seldom correlate with the reality of conditions inside an exhaust header pipe. As a practical matter, therefore, it is extremely difficult to obtain significant horsepower improvement using this technique because the horsepower increases occur only at very precise, and often unpredictable, engine speeds.

Another common misconception with high-performance exhaust systems is that engine performance may also be increased by reducing the cross-sectional area of the exhaust system piping at a location slightly downstream of the merge location of two or more primary headers, to create a converging-diverging choke point that accelerates the exhaust gases. It is thought that this velocity increase can fluidly couple the header pipes and create a Venturi effect which scavenges the exhaust gases from the inactive header pipe(s). However, studies have shown that this configuration will only be effective within a certain engine rpm band when the multiple exhaust gas pulses being sequentially discharged from each primary header are adequately spaced so as to not interfere with the others, and will progressively become ineffective at off-timing speeds as the multiple gas pulses begin to obstruct one another and create a constriction at the choke point. Additionally, expansion in the primary header pipes and subsequent recompression at the venturi choke point is detrimental to exhaust scavenging.

SUMMARY OF THE INVENTION

As broadly described herein, a representative embodiment of the present invention comprises an oval-to-round (or obround-to-round) exhaust collector system for discharging a flow of exhaust gases from an internal combustion engine. The exhaust collector system includes a plurality of primary headers having their discharge portions merged together at a merge angle into a substantially oval-shaped manifold outlet, and a substantially-round secondary pipe having a pipe inlet with a diameter greater than the diameter of the primary headers. The exhaust collector system also includes an oval-to-round collector flowtube which has a substantially oval-shaped collector inlet that is coupled with the manifold outlet and a substantially-round collector outlet that is coupled with the pipe inlet. The collector flowtube has a constant circumference along its entire length and a transverse cross-sectional area that continuously increases from the collector inlet to the collector outlet to cause a continuous expansion of the flow of exhaust gases.

As broadly described herein, another representative embodiment of the present invention comprises an oval-to-round (or obround-to-round) merge collector for directing a flow of exhaust gases from an internal combustion engine. The oval-to-round merge collector includes a collector flowtube of constant circumference along its entire length thereof, and which has a substantially oval-shaped collector inlet for coupling with a substantially oval-shaped manifold outlet formed from a plurality of primary headers having discharge portions merged together at a merge angle, as well as a substantially-round collector outlet for coupling with the substantially-round pipe inlet of a secondary pipe having a diameter greater than a diameter of the primary headers. Furthermore, the transverse cross-sectional area of the collector flowtube from the collector inlet to the collector outlet continuously increases as the tube shape changes to cause a continuous expansion of the flow of exhaust gases.

As broadly described herein, yet another representative embodiment of the present invention comprises an oval-to-round (or obround-to-round) exhaust collector system for discharging a flow of exhaust gases from an internal combustion engine. The exhaust collector system includes a first and a second plurality of primary headers which are merged together at a first merge angle into first and second substantially oval-shaped manifold outlets, respectively. The system also includes first and second oval-to-round collector flowtubes, with each flowtube having a constant circumference along its entire length thereof and a substantially oval-shaped collector inlet coupled with a respective first and second manifold outlet. The system further includes a third oval-to-round collector flowtube of constant circumference along its entire length thereof and having a substantially oval-shaped third collector inlet and a substantially-round third collector outlet. Furthermore, the first and second collector flowtubes are merged together at a second merge angle to form a third substantially oval-shaped manifold outlet that is coupled to the substantially oval-shaped collector inlet of the third collector flowtube, so that a flow of an exhaust gas from any primary header, through a respective first or second collector flowtube and into the third collector flowtube does not encounter a reduction in transverse cross-sectional area along the flow path thereof.

As broadly described herein, yet another representative embodiment of the present invention comprises a quad oval-to-round (or obround-to-round) merge collector for directing a flow of exhaust gases from an internal combustion engine. The quad oval-to-round merge collector includes a first and a second collector flowtube, each flowtube having a constant circumference along its entire length thereof and a substantially oval-shaped collector inlet for coupling with a substantially oval-shaped manifold outlet that has been formed from a plurality of primary headers merged together at a first merge angle. The quad merge collector further includes a third collector flowtube of constant circumference along its entire length thereof, and which also has a substantially oval-shaped third collector inlet and a substantially-round third collector outlet. The first and second collector flowtubes are merged together at a second merge angle to form a third substantially oval-shaped manifold outlet that is coupled to the substantially oval-shaped collector inlet of the third collector flowtube to form a uni-body, 4:2:1 multi-level merge collector. Furthermore, the transverse cross-sectional area through the merge collector from either of the first or second collector inlet to the third collector outlet continuously increases to cause a continuous expansion of the flow of exhaust gases.

As broadly described herein, yet another representative embodiment of the present invention comprises a method of forming an oval-to-round (or obround-to-round) exhaust gas exhaust collector system for an internal combustion engine. The method includes obtaining an oval-to-round collector flowtube which has a substantially oval-shaped collector inlet, a substantially-round collector outlet and a constant circumference along its entire length thereof. The method includes coupling the collector inlet to a substantially oval-shaped manifold outlet formed from a plurality of primary headers with discharge portions merged together at a merge angle. The method further includes coupling the collector outlet to a substantially-round secondary pipe having a pipe inlet diameter that is greater than the diameter of the primary headers, so that a flow path of the exhaust gas from any primary header, through the collector flowtube and into the secondary pipe does not encounter a reduction in transverse cross-sectional area along the flow path thereof.

BRIEF DESCRIPTION OF THE DRAWINGS

Features and advantages of the present invention will be apparent from the detailed description that follows, and when taken in conjunction with the accompanying drawings together illustrate, by way of example, features of the invention. It will be readily appreciated that these drawings merely depict representative embodiments of the present invention and are not to be considered limiting of its scope, and that the components of the invention, as generally described and illustrated in the figures herein, could be arranged and designed in a variety of different configurations. Nonetheless, the present invention will be described and explained with additional specificity and detail through the use of the accompanying drawings, in which:

FIGS. 9A and 9B together illustrate schematic top and side views of the flow lines of an exhaust gas as it passes through the exhaust collector system of FIG. 1;

FIG. 10 illustrates an exploded view of an oval-to-round exhaust collector system, in accordance with another representative embodiment of the present invention;

FIG. 11 illustrates an end view of the primary header assembly of the embodiment of FIG. 10, as viewed from Section Line E-E;

FIG. 12 illustrates an exploded view of an oval-to-round exhaust collector system, in accordance with yet another representative embodiment of the present invention;

FIG. 13 illustrates an end view of the primary header assembly of the embodiment of FIG. 12, as viewed from Section Line F-F;

FIGS. 14A-14C together illustrate schematic views of several multi-level oval-to-round exhaust collector systems, each in accordance with a representative embodiment of the present invention;

DETAILED DESCRIPTION OF EXEMPLARY EMBODIMENTS

The following detailed description makes reference to the accompanying drawings, which form a part thereof and in which are shown, by way of illustration, various representative embodiments in which the invention can be practiced. While these embodiments are described in sufficient detail to enable those skilled in the art to practice the invention, it should be understood that other embodiments can be realized and that various changes can be made without departing from the spirit and scope of the present invention. As such, the following detailed description is not intended to limit the scope of the invention as it is claimed, but rather is presented for purposes of illustration, to describe the features and characteristics of the representative embodiments, and to sufficiently enable one skilled in the art to practice the invention. Accordingly, the scope of the present invention is to be defined solely by the appended claims.

Furthermore, the following detailed description and representative embodiments of the invention will best be understood with reference to the accompanying drawings, wherein the elements and features of the embodiments are designated by numerals throughout.

Illustrated in FIGS. 1-17 are several representative embodiments of an exhaust collector system for discharging a flow of exhaust gases from an internal combustion engine, which embodiments also include one or more methods for making an exhaust gas exhaust collector system for an internal combustion engine. As described hereinbelow, the exhaust collector system provides several significant advantages and benefits over other devices and methods for discharging a flow of exhaust gases from an internal combustion engine. However, the recited advantages are not meant to be limiting in any way, as one skilled in the art will appreciate that other advantages may also be realized upon practicing the present invention.

Figure 1:
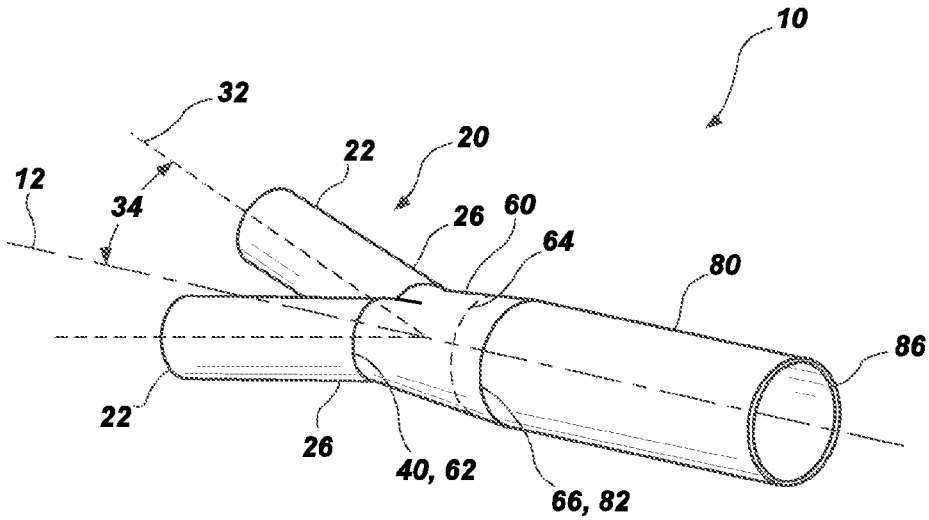
FIG. 1 illustrates a perspective view of an oval-to-round exhaust collector system, in accordance with a representative embodiment of the present invention.
Figure 2:
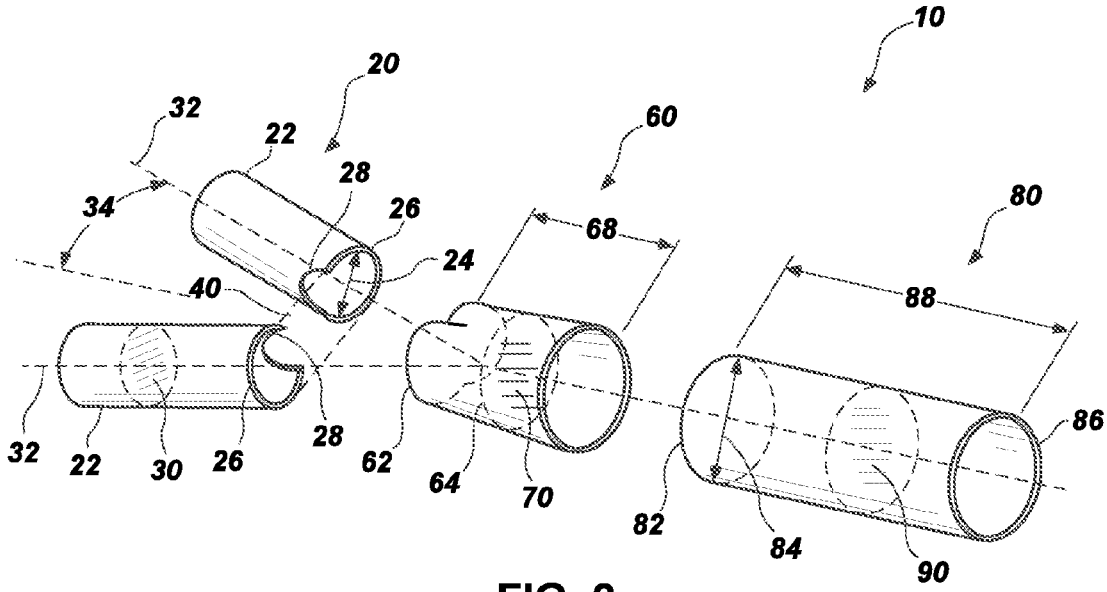
FIG. 2 illustrates an exploded view of the embodiment of FIG. 1.

Illustrated in FIGS. 1 and 2 are perspective assembled and exploded views of a substantially oval-to-round (or substantially obround-to-round) exhaust collector system 10, respectively, in accordance with one representative embodiment of the present invention. The exhaust collector system 10 includes a header assembly 20 which comprises a plurality of primary headers 22 having discharge portions 26 merged together at a merge angle 34 (and without expansion of the sidewalls of the headers) into a substantially oval-shaped or obround-shaped manifold outlet 40. The primary headers 22 can be substantially-round pipes of equal diameter 24 and constant cross-sectional area 30. Furthermore, the merge angle 34 can be measured relative to a common centerline 12 of the exhaust collector system, so that the total angle between the two primary headers in the header assembly is two times the merge angle 34. The merge angle 34 of the discharge portions 26 of the primary headers relative to the common centerline 12 can range from about five degrees to about twenty-five degrees The exhaust collector system also includes a substantially-round secondary pipe 80 having a pipe inlet 82 with a diameter 84 greater than a diameter 24 of any one of the primary headers 22. The secondary pipe 80 can have a length 88 equal to or greater than one-half the diameter of the secondary pipe inlet 82. In one aspect the secondary pipe 80 can have a substantially-constant transverse cross-sectional area 90 along its entire length. Alternatively, the secondary pipe 90 can have a conical shape with an increasing transverse cross-sectional area from its inlet 82 to its outlet 86.

The exhaust collector system further includes a collector flowtube 60 of constant circumference 64 along its entire length 68 thereof. The flowtube has a substantially oval-shaped or obround-shaped collector inlet 62 which can be directly coupled, such as by welding, to the manifold outlet 40, and a substantially-round collector outlet 66 which can be directly coupled, such as by welding, to the secondary pipe inlet 82. As described herein, the terms "oval" and "obround" can be used interchangeably to described elongate shapes having rounded ends and flat or nearly-flat top and bottom sides, and which shapes can vary based upon the number of primary headers which are merged together to form the substantially oval or obround-shaped manifold outlet 40.

Both the substantially oval-shaped collector inlet 62 and the substantially-round collector outlet 66 can be formed without expansion, stretching or "swaging" of the sidewalls of the collector flowtube, such as with an ovalizing process, so that the constant circumference is maintained. Therefore, in accordance with the geometrical relationship that the shape which encloses the maximum area for any predetermined circumference is a circle (e.g. the collector outlet 66 in the case of the present invention), and that any non-circular shape having the same circumference will thus enclose a smaller area (e.g. the substantially oval-shaped collector inlet 62), the transverse cross-sectional area 70 of the collector flowtube can continuously increase from the collector inlet 62 to the collector outlet 66. In turn, this can advantageously lead to the continuous expansion of the flow of exhaust gases as they pass through the collector flowtube, but without the expansion, stretching or swaging of the sidewalls of a merge collector which can add complexity and cost to the exhaust system.

Each of the components of the exhaust collector system can be made from a metal or metal alloy, such as carbon steel, a carbon steel alloy, a stainless steel alloy or a titanium alloy, etc., which can either be welded, brazed, bolted or otherwise coupled together to form a rigid joint, and which is temperature resistant to handle the high-temperature exhaust gas. Alternatively, each of the components can be made from a high-temperature ceramic or composite material which can be coupled together using other methods such as adhesives and/or fasteners, etc.

Figure 3A:
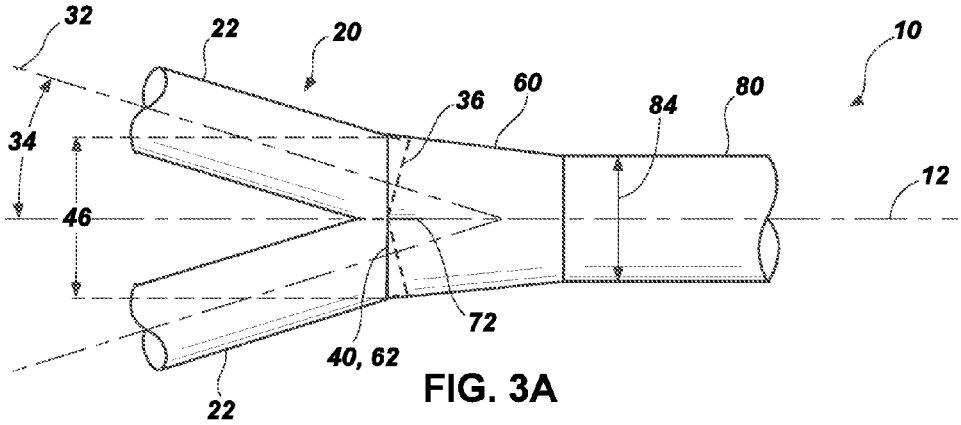
FIGS. 3A and 3B together illustrate the top and side views of the embodiment of FIG. 1.
Figure 3B:
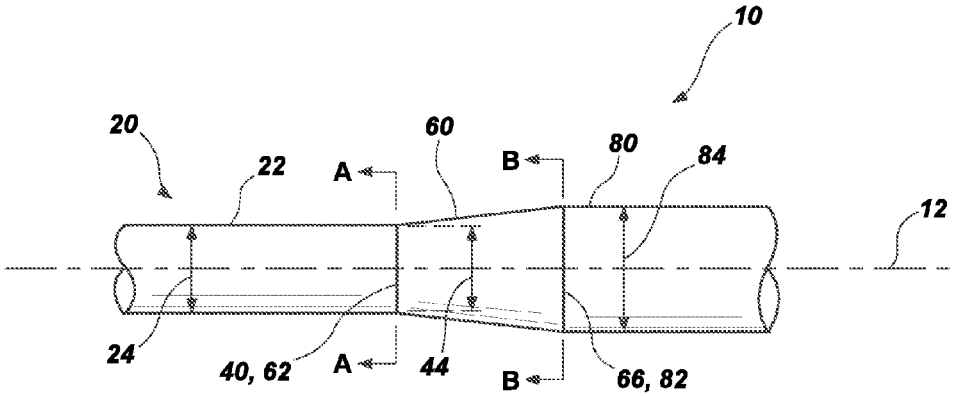

As can be seen in FIGS. 2, 3A and 3B, the discharge portions 26 of each primary header can be cut along a plane which intersects the longitudinal axis 32 of the primary headers at the merge angle 34 to form an ellipsoidal-shaped cutout 28. During assembly of the primary headers 22 into the header assembly 20, the edges of the cut-outs 28 can be aligned and coupled together with welding, brazing or a similar manufacturing process. The remaining angled outer edges 36 (FIG. 3A) of the primary headers which project beyond the centerline merge point can be trimmed back to form the flat face of the substantially oval-shaped manifold outlet 40 that is perpendicular to the common centerline or longitudinal axis 12 of the exhaust collector system.

Because the primary headers 22 merge at an angle equal to two times the merge angle 34, the manifold outlet 40 can have a transverse cross-sectional area that is less than the combined transverse cross-sectional areas of the two primary headers before they merge together. Moreover, the height 44 (FIG. 3B) of the oval-shaped manifold outlet can be substantially equal to the diameter 24 of the primary headers, while the width 46 (FIG. 3A) of the oval-shaped manifold outlet is determined by the circumference 64 of the constant circumference collector flowtube 60 after the collector inlet has been ovalized to match the height 44 of the manifold outlet 40.

In comparing the top and side views of the exhaust collector system 10 illustrated in FIGS. 3A and 3B, respectively, it can be seen that the width 46 of the manifold outlet 40 (and collector inlet 62) is slightly greater than the diameter 84 of the inlet 82 of the secondary pipe 80 (and collector outlet 66), so that the collector flowtube 60 narrows slightly from the collector inlet to the collector outlet when viewed from above (see FIG. 3A). However, the height 44 of the manifold outlet 40 (and collector inlet 62) is substantially less than the diameter 84 of the secondary pipe 80 (and collector outlet 66), so that the collector flowtube expands significantly from the collector inlet to the collector outlet when viewed from the side (see FIG. 3B). Because the rate of expansion in the vertical plane is greater than the rate of contraction in the horizontal plane, it is to be appreciated that the transverse cross-sectional area of the collector flowtube 60 continuously increases from the collector inlet to the collector outlet, as described above.

Figure 4A:
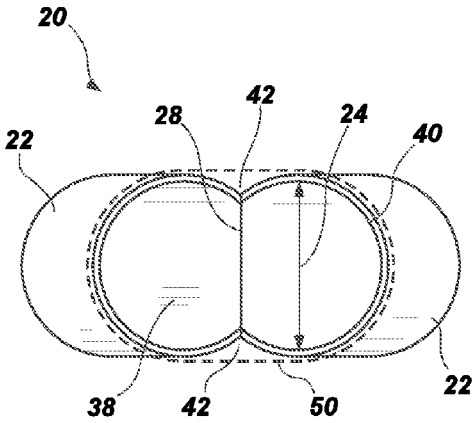
FIGS. 4A and 4B together illustrate cross-sectional end views of the embodiment of FIG. 3B, as taken along Section Line A-A and Section Line B-B, respectively.

FIG. 4A illustrates an end view of the manifold outlet 40 of the primary header assembly 20, as viewed from Section Line A-A of FIG. 3B. The two primary headers 22 are coupled together along the split line defined by the ellipsoidal cutouts 28 as seen head-on, with the outer surfaces of the primary headers extending laterally away from each other. As can be seen, the substantially oval or obround-shaped manifold outlet 40 deviates from an idealized oval or obround shape 50 in that triangular merge creases 42 are formed at the top and bottom of the manifold outlet. This is because the two rounded header pipes 22 of diameter 24 are joined together before reaching to their respective midpoints. Depending on the ratio between the diameters 24 of the primary headers 22 and the diameter of the secondary pipe inlet, these merge creases can be more or less pronounced than those shown in FIG. 4A. Also shown in FIG. 4A are the interior sidewall surfaces 38 of the primary headers 22.

Figure 4B:
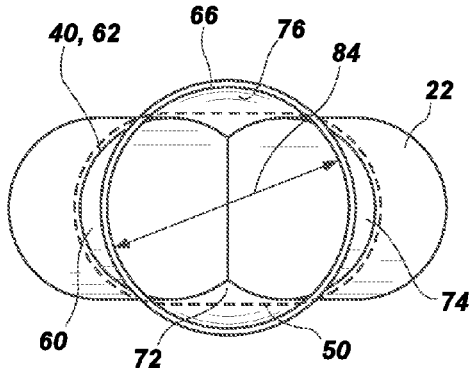

Illustrated in FIG. 4B is an end view of the collector outlet 66 looking back towards the primary header assembly 20, as viewed from Section Line B-B of FIG. 3B. The inlet end of the constant-circumference cylindrical flowtube 60 can be ovalized until it forms the idealized oval or obround shape 50 having a height that matches the diameter of the primary headers. Pinch creases 72 can then be pressed into the top and bottom edges of the inlet end to match the merge creases formed in the manifold outlet 40 to create the substantially-oval shaped collector inlet 62. The pinch creases 72 can be minor alterations in the profile of the collector inlet which do not appreciably alter the circumference of the flowtube 60 nor the transverse cross-sectional area of the collector inlet 62, allowing the collector flowtube to maintain a constant circumference along its entire length from inlet 62 to outlet 66. Also shown in FIG. 4B are the exterior 74 and interior 76 sidewall surfaces of the collector flowtube 60.

Figure 5A:
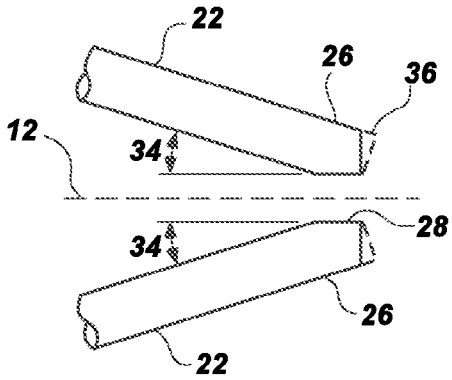
FIGS. 5A and 5B together illustrate exploded and assembled top views of the primary header assembly of the embodiment of FIG. 1.
Figure 5B:
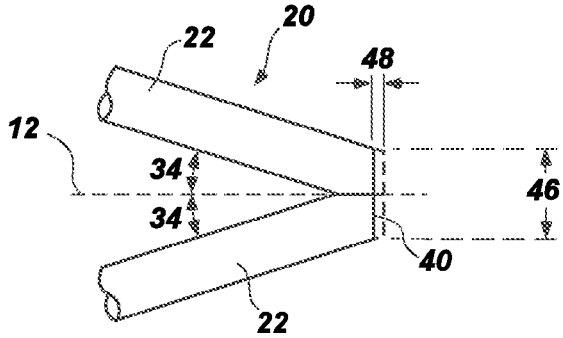

Referring now to FIG. 5A, the primary header assembly can be formed by cutting the discharge portions 26 of the two primary headers 22 at merge angles 34 relative to the longitudinal axis of the header pipes to create the cutouts 28 which have an ellipsoidal shape. The edges of the cutouts 28 can be coupled together, as in FIG. 5B, which aligns the two primary headers at an angle equal to two times the merge angle 34. The remaining angled outer edges 36 of the primary headers 22 can be trimmed back to form the flat face of the substantially oval-shaped manifold outlet 40 that is perpendicular to the longitudinal axis 12 of the exhaust collector system. If needed, the merged discharge portions 26 can be cut back further by a trim distance 48 until the width dimension 46 of the manifold outlet 40 matches the width dimension of the substantially oval-shaped collector inlet. It may be appreciated that trimming back the merged discharge portions 26 increases the width 46 of the manifold outlet while leaving the height 44 unchanged.

Figure 6:
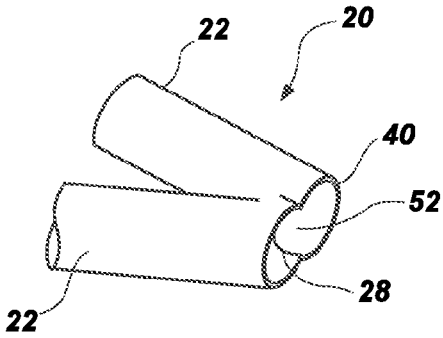
FIG. 6 illustrates an isolated, perspective view of the primary header assembly of the embodiment of FIG. 1.

A perspective view of the completed primary header assembly 20 having a trimmed manifold outlet 40 is shown in FIG. 6. As can be seen, the coupled cutouts 28 define a curved transition opening 52 that extends upstream a short distance from the plane of the manifold outlet. This transition opening allows a small portion of an exhaust flow traveling through one of the primary headers 22 to cross over into the volume previously defined by an adjacent primary header. However, the curved edges of the transition opening combined with the momentum of the high-velocity gas flow limits most of the expansion until after the exhaust flow has passed through the manifold outlet 40 and into the inlet of the collector flowtube.

Figure 7:
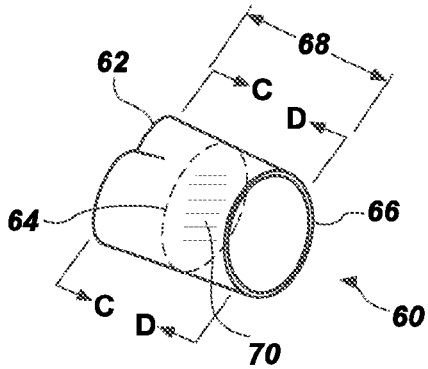
FIG. 7 illustrates an isolated, perspective view of the oval-to-round merge collector of the embodiment of FIG. 1.
Figure 8A:
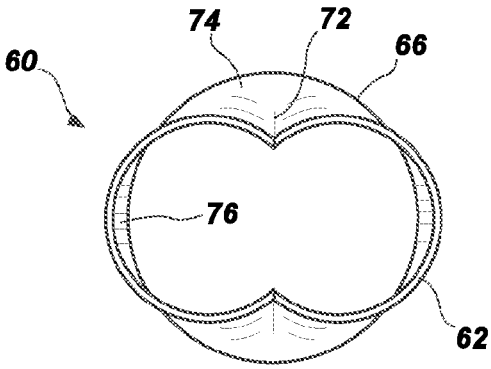
FIGS. 8A and 8B together illustrate end views of the isolated oval-to-round merge collector of FIG. 7, as viewed from Section Lines C-C and D-D, respectively.
Figure 8B:
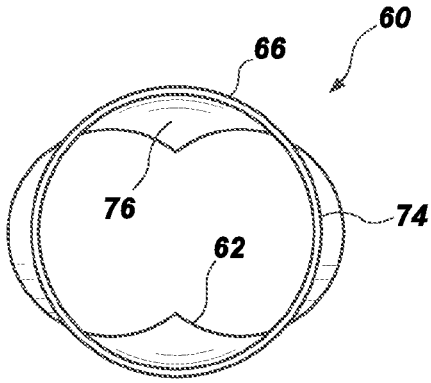

FIG. 7 shows an individual collector flowtube 60, or merge collector, having an inlet 62, and outlet 66 and a constant circumference 64 along the length 68 thereof, in accordance with one representative embodiment of the present invention. The collector inlet 62 as viewed from Section Line C-C is shown in FIG. 8A, while the collector outlet 66 as viewed from Section Line D-D is shown in FIG. 8B. In both cases the expansion of transverse cross-sectional area 70 from the ovalized inlet to the substantially-round outlet is apparent from the differences in the amount of exterior sidewall surface 74 and interior sidewall surface 76 visible from either end.

Schematic diagrams of the flow path of an exhaust flow 14 traveling through the oval-to-round exhaust collector system 10 is shown in FIGS. 9A and 9B. As may be appreciated by one of skill in the art, each primary header can be in fluid communication with a power cylinder exhaust port (not shown) in the internal combustion engine, and which power cylinder undergoes combustion in relation to the other power cylinders and in accordance with a predetermined firing sequence or order. In most cases, the primary headers and ignition sequence can be configured so that an exhaust flow though any primary header occurs at a different point in the engine cycle than the exhaust flow through the adjacent primary header, which spacing can up to 360 degrees of rotation in a 4-cycle engine. This can ensure that an exhaust flow 14 travels through only one of the primary headers in the primary header assembly 20 at a time. With the example illustrated in FIG. 9A, for instance, the exhaust gases are depicted as flowing through a lower, active primary header 22*a*, with an upper primary header 22*b* being temporarily inactive and filled with only residual exhaust gases.

FIGS. 9A and 9B together illustrate one advantage of the exhaust collector system 10 of the present invention, in that the high-temperature, high-velocity exhaust flow 14 from the internal combustion engine does not encounter a reduction in the cross-sectional area 16 of the exhaust collector system 10 at it travels from the primary header 22*a*, through the collector flowtube 60 and into the secondary pipe 80. Stated differently, the exhaust gases are not recompressed by any restriction in the cross-sectional area of the flow passage, and instead the gases are continuously expanded as they move through the exhaust collector system. Continuously expanding the exhaust flow can be beneficial by reducing the back pressure experienced by the internal combustion engine to generate a corresponding increase in power output and efficiency.

The cross-sectional area 16 of a flow passage can be considered equal to the transverse cross-sectional areas 30, 70, 90 of the primary headers 22, collector flowtube 60 or secondary pipe 80, respectively, including within the vicinity of the transition opening 52 defined by the ellipsoidal-shaped cutouts 28, and which is located immediately upstream of the manifold outlet 40. While the curved transition opening allows the flow passages of the primary headers to begin to intersect and merge into each other along a horizontal plane prior reaching the manifold outlet, any expansion of the gas flow through an active primary header is limited by the curved edges of the cutouts 28 above and below the transition opening and by the momentum of the exhaust flow 14. Thus, for the short distance between the beginning of the transition opening and the manifold outlet, an effective boundary continues to limit the cross-sectional area 16 of either flow passage as if the circular sidewalls of the active primary header temporarily extended into the adjacent inactive primary header. Upon reaching the manifold outlet 40, however, the cross-sectional area of the flow passage immediate expands to encompass the entire transverse cross-sectional area of the collector inlet.

The continuous expansion of the exhaust flow 14 in the exhaust collector system 10 of the present invention can be accomplished, in part, by the collector flowtube 60 having a transverse cross-sectional area 70 that gradually transitions from a substantially-oval shape in the inlet 62 with a particular circumference, to a substantially-round shape having the same circumference at the outlet 66. As stated above, this results in a continuous increases in the cross-sectional area 16 experienced by the exhaust gases. Moreover, this continuous expansion is unlike the flow path found in other exhaust collector systems, which often have a constriction, or a converging/diverging section, formed along the length of its collector flowtube or merge collector to generate a scavenging affect on the inactive primary header. Although the converging/diverging sections found in the prior art exhaust systems is thought to increase the velocity of the exhaust gas to draw residual exhaust gases out of an inactive primary header, the constriction can actually increase back pressure experienced by a power cylinder that is associated with an active primary header.

With the oval-to-round collector flowtube 60 installed into the exhaust collector system of the present invention 10, however, the exhaust flow 14 can be continuously expanded to reduce back pressure in the active primary header 22*a* while generating a scavenging affect in the inactive primary header 22*b* through another process. This can be accomplished by directing the high-velocity exhaust flow from the active header over the mouth 18*a* of the inactive primary header 22*b* as it passes through the manifold outlet 40 to create a unidirectional venturi effect. This venturi effect can draw down the residual exhaust gases present in the inactive primary header 22*b* and send a rarifying pulse up the inactive header towards its associated power cylinder exhaust port. Depending on the temperature of the exhaust gases, length of the primary headers, timing of the ignition sequence and speed of the engine, the rarifying pulse can reach the exhaust port at about the same time that the exhaust port is opened to discharge the hot exhaust gases from combustion. Consequently, the back pressure seen by the inactive header's power cylinder may be temporarily reduced to levels below the normal pressure that it would otherwise experience as the exhaust collector system of the present invention 10 creates an enhanced scavenging effect.

In accordance with another representative embodiment 100 of the present invention, FIG. 10 illustrates an exploded view of an oval-to-round exhaust collector system having three primary headers 112*a*, 112*b*, 112*c* that are merged together at merge angle 116 (and without expansion of the sidewalls of the headers) to form a three-header assembly 110 having a substantially oval-shaped manifold outlet 120. The discharge portions of each the three primary headers can be cut along a plane which intersects the longitudinal axis 108 of the header at the merge angle 116 to form a ellipsoidal-shaped cut-out 122, with the center primary header 112*b* having a cut-out on both sides. During assembly the three primary headers can be aligned with respect to each other at an angle equal to two times the merge angle 116 (which merge angle 116 can range from about five degrees to about twenty-five degrees relative to a common axis), and the edges of the cut-outs 122 can be coupled together with welding, brazing or a similar manufacturing process as described above.

Also shown in FIG. 10 is a collector flowtube 130 having a substantially oval-shaped collector inlet 132, a substantially round collector outlet 136, and a constant circumference 134 along the entire length 138 thereof. A secondary pipe 140 having a pipe inlet 142 with a diameter 144 that is greater than the diameter 114 of any one of the primary headers 112 is also shown. The inlet end 132 of the collector flowtube can be ovalized without expanding or swaging the walls of the flowtube until it forms an oval shape having a height that matches the height of the manifold outlet 120.

Illustrated in FIG. 11 is the substantially oval-shaped manifold outlet 120 of the three-header assembly 110, as viewed from Section Line E-E of FIG. 10. The manifold outlet can have a height 124 equal to the diameter 114 of the primary headers, and a width 126 determined by the circumference of the collector flowtube after the collector inlet has been ovalized to match the height 124 of the manifold outlet 120. The manifold outlet can deviate from an idealized oval shape in that triangular merge creases 128 are formed in both the top and bottom of the manifold outlet, since the three primary header pipes are coupled together before reaching to their respective midpoints. Moreover, pinch creases 148 can also be formed into the top and bottom edges of the collector inlet 132 (FIG. 10) to match the merge creases 128 in the manifold outlet 120.

In accordance with yet another representative embodiment 150 of the present invention, FIG. 12 illustrates an exploded view of an oval-to-round exhaust collector system having four primary headers 162*a*, 162*b*, 162*c*, 162*d* that are merged together at merge angles 166, 168 (and without expansion of the sidewalls of the headers) to form a primary header assembly 160 having a substantially oval-shaped manifold outlet 170. The inside of the ends of the two inner primary headers 162*b*, 162*c* can be cut along a plane which intersects the longitudinal axes 158 of the primary headers at the inner merge angle 166 to form ellipsoidal-shaped cut-outs 172, while the outside of the ends of the two inner primary headers and the inside of the ends of the two outer primary headers 162*a*, 162*d* can be cut at the outer merge angle 168, also to also form ellipsoidal-shaped cut-outs 172. The inner merge angle 166 of the discharge portions of the two inner primary headers relative to a common centerline 152 can range from about five degrees to about twenty-five degrees, while the outer merge angle 168 can be equal to or greater than the inner merge angle 166, and in one aspect can be about two times the inner merge angle. During assembly of the four primary headers into the header assembly 160, the edges of the cut-outs 172 can be coupled together to align the four primary headers at two times the merge angles 166, 168 and to form a primary header assembly having a fan shape.

Also shown in FIG. 12 is a collector flowtube 180 having a substantially oval-shaped collector inlet 182, substantially round collector outlet 186, and a constant circumference 184 along the entire length 188 thereof, as well as the secondary pipe 190 having a pipe inlet 192 with a diameter 194 that is greater than a diameter 164 of any one of the primary headers 162*a*, 162*b*, 162*c*, 162*d*. The inlet end 182 of the collector flowtube can be ovalized without expanding or swaging the walls of the flowtube until it forms an oval shape having a height that matches the height of the manifold outlet 170.

Illustrated in FIG. 13 is the substantially oval-shaped manifold outlet 170 of the four-header assembly 160, as viewed from Section Line F-F of FIG. 12. The manifold outlet can have a height 174 equal to the diameter 164 of the primary headers, and a width 178 determined by the circumference of the collector flowtube after the collector inlet has been ovalized to match the height 174 of the manifold outlet 170. As with the embodiments described above, the manifold outlet 170 can deviate from an idealized oval shape in that triangular merge creases 178 are formed in both the top and bottom of the manifold outlet. Referring back to FIG. 12, pinch creases 198 can also be formed into the top and bottom edges of the collector inlet 182 to match the merge creases 178 in the manifold outlet 170.

Referring now to FIGS. 14A-14C, with any of the header assemblies 20, 110, 160 described above having two, three or four primary headers, respectively, it is to be appreciated that the secondary pipe 80, 140, 190 which receives the exhaust flow from the collector flowtube 60, 130, 180 may be merged with another secondary pipe 80*a*, 140*a*, 190*a* that receives an exhaust flow from a substantially similar header assembly 20*a*, 110*a*, 160*a* and collector flowtube 60*a*,130*a*, 180*a*, as shown in the representative multi-level embodiments 204, 206 and 208, respectively. In each multi-level embodiment illustrated, the set of two secondary pipes (60, 60*a*), (130, 130*a*), (180, 180*a*) can be merged together at another merge angle 222 (and without expansion of the sidewalls of the secondary pipes) using a third and larger-sized oval-to-round collector flowtube 220 that leads to a substantially round tertiary pipe 240. The tertiary pipe 240 can have a pipe inlet 242 with a diameter greater than the diameter of the secondary pipes, and having a pipe outlet 246 leading directly to an exhaust system outlet, a sound suppression system (e.g. a muffler) or a catalytic converter, etc. (not shown).

It is to be appreciated, therefore, that the exhaust collector system of the present invention can be expanded to form a multi-level exhaust collector system that reduces the number of exhaust pipes through a 4:2:1, a 6:2:1 or an 8:2:1 grouping ratio, respectively. This can have particular application with internal combustions engines having four, six and eight power cylinders and their associated exhaust ports evenly arranged on both sides of the internal combustion engine 214, 216, 218. In each embodiment 204, 206, 208, moreover, the high-temperature, high-velocity exhaust gas flowing from the internal combustion engine does not encounter a reduction in the cross-sectional area of the exhaust collector system at it travels from the primary headers, through the collector flowtubes, secondary pipes and third collector flowtube 220, and into the tertiary pipe 240, resulting in an exhaust collector system that provides superior performance over exhaust systems currently available in the art.

In yet another aspect of the present invention, the multi-level exhaust collector systems shown in FIGS. 14A-14C can be used in combination with other engine configurations, such as in-line four and six cylinder engines and light aircraft engines which may port all of the exhaust gases to one side, or in different groupings to accommodate engines having ten, twelve, fourteen or sixteen cylinders, etc., or in non-symmetrical groupings to accommodate engines having an odd number of cylinders.

Figure 15A:
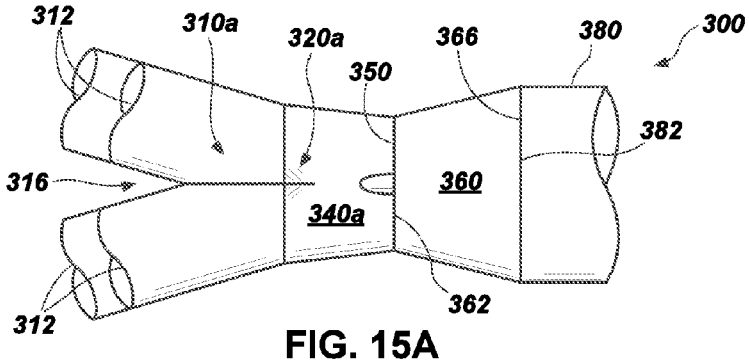
FIGS. 15A-15C together illustrate the top, side and end views an oval-to-round exhaust collector system, in accordance with yet another representative embodiment of the present invention.
Figure 15B:
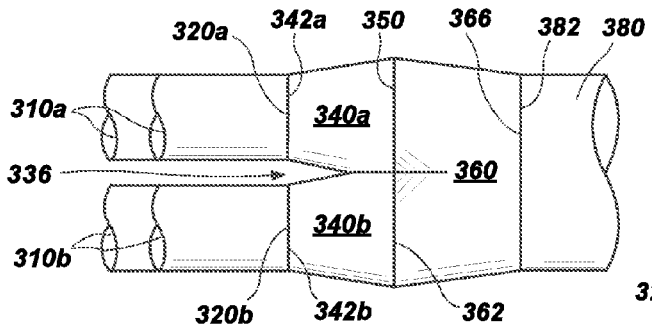
Figure 15C:
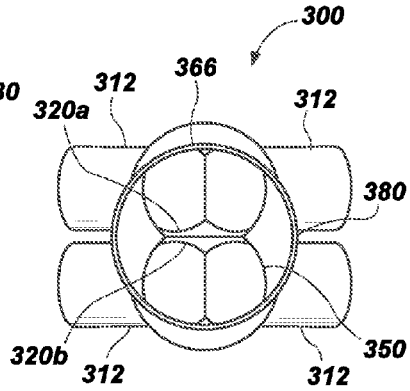
Figure 16:
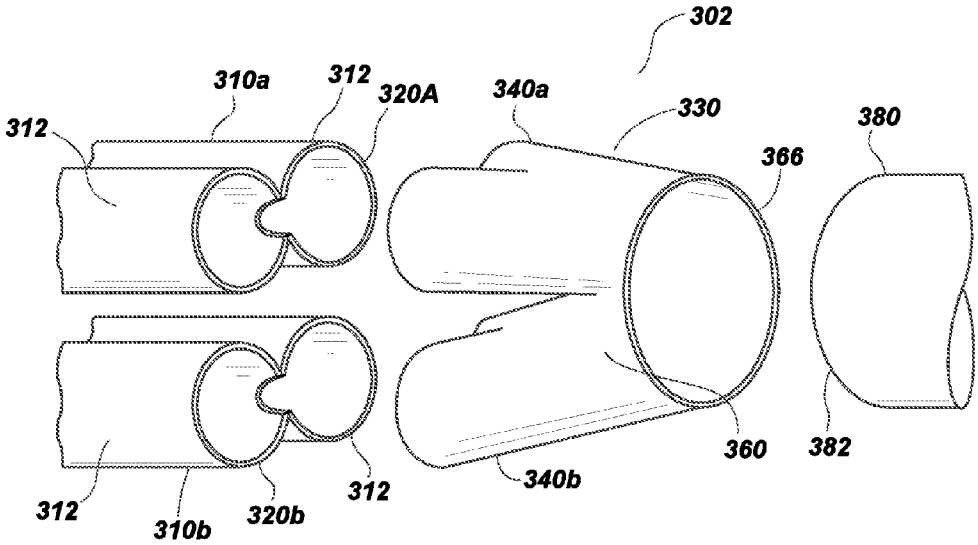
FIG. 16 illustrates a perspective view of a quad oval-to-round merge collector, in accordance with another representative embodiment of the present invention.

Another representative embodiment 300 of the present invention is illustrated in FIGS. 15A-15C, and which may be considered an alternative configuration to the 4:1 exhaust collector system 150 described above. Instead of all four 312 primary headers being aligned together in one plane, the headers are grouped into two header assemblies 310*a*, 310*b* of two primary headers 312 each, one above the other, with the headers in each primary header assembly being merged together at a first merge angle 316, and without expansion of the sidewalls of the headers, to form a substantially oval-shaped first and second manifold outlets 320*a*, 320*b*. The two manifold outlets are then coupled to the substantially oval-shaped inlet ends 342*a*, 342*b* of a first oval-to-round collector flowtube 340*a* and a second oval-to-round collector flowtube 340*b*, respectively, both of which have a constant circumference along their entire lengths.

As can be seen in FIG. 15B, the first and second collector flowtubes 340*a*, 340*b* can also be inclined with respect to each other at a second merge angle 336 located about an axis perpendicular to the axis of the first merge angles 316, and their tubular bodies can begin to merge into each other even before the flowtubes have completed their transitions from oval to round. Consequently, at their substantially round outlet ends the first and second collector flowtubes have already been merged together without expansion of their sidewalls to form a substantially oval-shaped third manifold outlet 350 having a long axis orientated perpendicular to the long axes of the first and second manifold outlets 320*a*, 320*b*.

Furthermore, the third manifold outlet 350 can then be coupled to the substantially oval-shaped inlet 362 of a third and larger oval-to-round collector flowtube 360 which also maintains a constant circumference along its entire length as it transitions into a substantially-round third collector outlet 366. Finally, a substantially round pipe inlet 382 of a secondary pipe 380 can then be coupled to the collector outlet to complete the oval-to-round exhaust collector system 300 having a 4:2:1 multi-level reduction ratio. It is to be appreciated, moreover, that the secondary pipe 380 of embodiment 300 can also be merged with the secondary pipe extending from a similar exhaust collector system located on the other side of an internal combustion engine having an opposed bank of cylinders. Similar to the multi-level exhaust collector systems illustrated in FIGS. 14A-14C above, the two secondary pipes 380 can be merged at a merge angle to form a fourth manifold outlet coupled to a fourth and larger oval-to-round collector flowtube, and to form a multi-level exhaust collector system that reduces the number of exhaust pipes through an 8:4:2:1 grouping ratio (not shown).

Referring now to the end view of FIG. 15C, it can be seen that a flow of an exhaust gas from any primary header 312, through a respective first or second manifold outlet 320*a*, 320*b*, third manifold outlet 350 and third collector outlet 366, and into the substantially-round secondary pipe 380 does not encounter a reduction in transverse cross-sectional area along the flow path thereof. Moreover, a high-velocity exhaust flow discharging from any active primary header 312 can also operate to scavenge the three inactive primary headers by creating a venturi effect which draws down the residual exhaust gases present therein.

A similar embodiment 302 to that described above is illustrated in FIG. 16, in which first and second collector flowtubes 340*a*, 340*b* are combined together with the third collector flowtube 360 into a single uni-body to form a quad oval-to-round merge collector 330. Like the various individual components described above, the one-piece quad oval-to-round merge collector can combine the flow paths from the four primary headers 312 into a single secondary header 380 in such a manner that a flow of an exhaust gas discharged from either of the substantially oval-shaped first and second manifold outlets 320*a*, 320*b* of primary header assemblies 310*a*, 310*b*, through the merge collector 330 and into the pipe inlet 382 of the secondary pipe 380 does not encounter a reduction in cross-sectional area along the flow path thereof. Instead, the cross-sectional area of a flow passage ranging from the substantially oval-shaped inlet of either the first or second collector flowtubes 340*a*, 340*b* to the substantially-round third collector outlet 366 continuously increases to cause a continuous expansion of a flow of exhaust gases passing therethrough.

Figure 17:
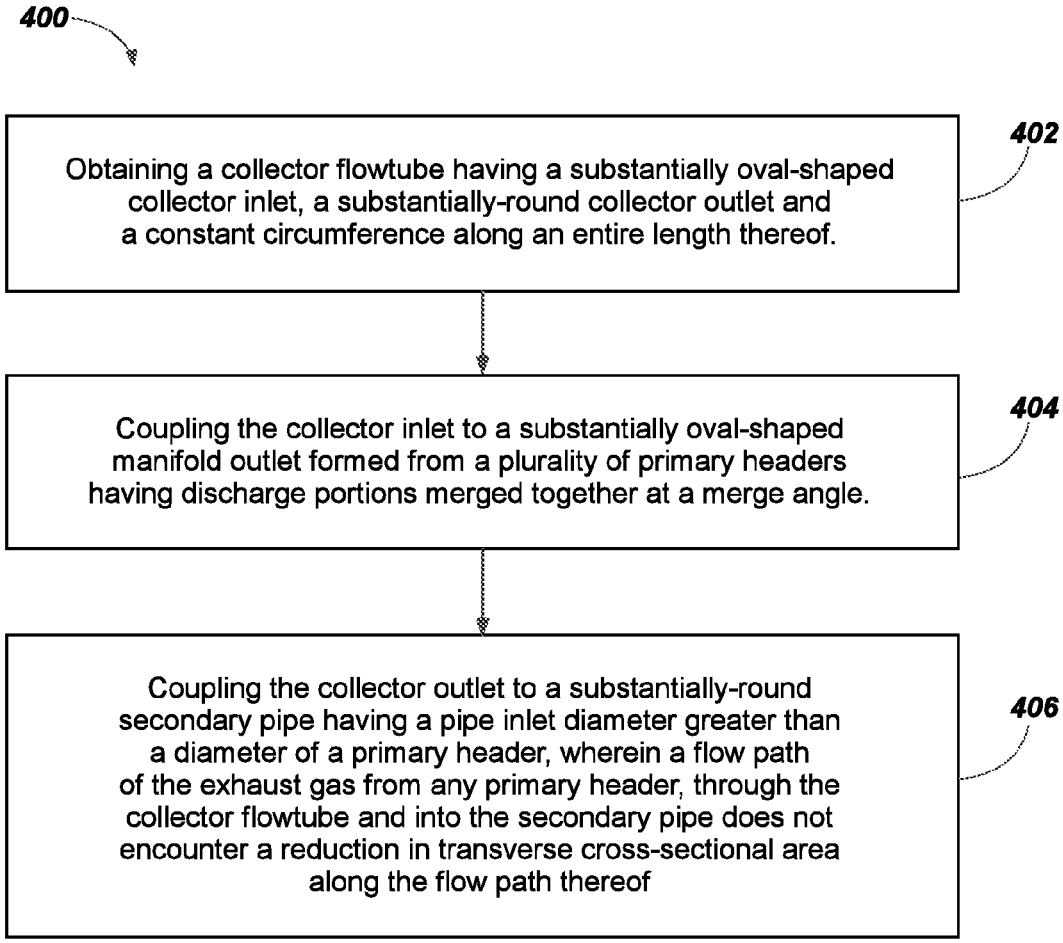
FIG. 17 is a flowchart depicting a method of forming an exhaust gas collector system for an internal combustion engine, in accordance with another representative embodiment of the present invention.

Illustrated in FIG. 17 is a flowchart depicting a method 400 of forming an oval-to-round exhaust gas exhaust collector system for an internal combustion engine, in accordance with another representative embodiment of the present invention. The method 400 includes obtaining 402 an oval-to-round collector flowtube which has a substantially oval-shaped collector inlet, a substantially-round collector outlet and a constant circumference along its entire length thereof. The method includes coupling 404 the collector inlet to a substantially oval-shaped manifold outlet formed from a plurality of primary headers with discharge portions merged together at a merge angle and without expansion of the sidewalls of the headers. The method further includes coupling 406 the collector outlet to a substantially-round secondary pipe having a pipe inlet diameter that is greater than the diameter of the primary headers, so that the path of an exhaust gas flow from any primary header, through the collector flowtube and into the secondary pipe does not encounter a reduction in cross-sectional area along the flow path thereof.

The foregoing detailed description describes the invention with reference to specific representative embodiments. However, it will be appreciated that various modifications and changes can be made without departing from the scope of the present invention as set forth in the appended claims. The detailed description and accompanying drawings are to be regarded as illustrative, rather than restrictive, and any such modifications or changes are intended to fall within the scope of the present invention as described and set forth herein.

More specifically, while illustrative representative embodiments of the invention have been described herein, the present invention is not limited to these embodiments, but includes any and all embodiments having modifications, omissions, combinations (e.g., of aspects across various embodiments), adaptations and/or alterations as would be appreciated by those skilled in the art based on the foregoing detailed description. The limitations in the claims are to be interpreted broadly based on the language employed in the claims and not limited to examples described in the foregoing detailed description or during the prosecution of the application, which examples are to be construed as non-exclusive. For example, any steps recited in any method or process claims, furthermore, may be executed in any order and are not limited to the order presented in the claims. The term "preferably" is also non-exclusive where it is intended to mean "preferably, but not limited to." Accordingly, the scope of the invention should be determined solely by the appended claims and their legal equivalents, rather than by the descriptions and examples given above.

What is claimed and desired to be secured by Letters Patent is:

1. An exhaust collector system for discharging a flow of exhaust gases from an internal combustion engine, comprising:

a plurality of primary headers having discharge portions merged together at a merge angle into a substantially oval-shaped manifold outlet;

a substantially-round secondary pipe having a pipe inlet with a diameter greater than a diameter of the primary headers; and a collector flowtube of constant circumference along an entire length thereof and having a substantially oval-shaped collector inlet coupled with the manifold outlet and a substantially-round collector outlet coupled with the pipe inlet, wherein a transverse cross-sectional area of the collector flowtube from the collector inlet to the collector outlet continuously increases to cause a continuous expansion of the flow of exhaust gases.

2. The exhaust collector system of claim 1, wherein the oval-shaped manifold outlet has a transverse cross-sectional area less than a combined transverse cross-sectional area of the plurality of primary headers.

3. The exhaust collector system of claim 1, wherein the plurality of primary headers are substantially-round pipes of equal diameter.

4. The exhaust collector system of claim 3, wherein the inlet of the secondary pipe has a diameter ranging from about one and a quarter times to about three times the diameter of a primary header.

5. The exhaust collector system of claim 1, wherein the discharge portions of the primary headers are merged together without expansion of the sidewalls of the primary headers.

6. The exhaust collector system of claim 1, wherein the merge angle of the discharge portions of the primary headers relative to a common centerline ranges from about five degrees to about twenty-five degrees.

7. The exhaust collector system of claim 1, wherein the substantially oval-shaped collector inlet is formed without expansion of the sidewalls of the collector flowtube.

8. The exhaust collector system of claim 1, wherein the secondary pipe has a length equal to or greater than one-half the diameter of the substantially-round collector outlet, and a substantially-constant transverse cross-sectional area along the length thereof.

9. The exhaust collector system of claim 1, wherein the plurality of primary headers comprises two first header pipes.

10. The exhaust collector system of claim 1, wherein the plurality of primary headers comprises at least three first header pipes.

11. The exhaust collector system of claim 1, wherein a flow of an exhaust gas from any primary header, through the collector flowtube and into the secondary pipe does not encounter a reduction in cross-sectional area along the flow path thereof.

12. The exhaust collector system of claim 1, further comprising:

a second plurality of primary headers having discharge portions merged together at the merge angle into a second substantially oval-shaped manifold outlet;

a second substantially-round secondary pipe having a second pipe inlet with a diameter greater than the diameter of the primary headers;

a second collector flowtube of constant circumference along an entire length thereof having a substantially oval-shaped collector inlet coupled with the second manifold outlet and a substantially-round collector outlet coupled with the second pipe inlet; and a third collector flowtube of constant circumference along an entire length thereof having a substantially oval-shaped collector inlet and a substantially-round collector outlet;

wherein the two secondary pipes merge together at a second merge angle into a third substantially oval-shaped manifold outlet coupled to the substantially oval-shaped collector inlet of the third collector flowtube.

13. The exhaust collector system of claim 12, wherein a flow of an exhaust gas from any primary header, through a respective collector flowtube and a secondary pipe, and through the third collector flowtube does not encounter a reduction in transverse cross-sectional area along the flow path thereof.

14. The exhaust collector system of claim 12, wherein each of the plurality of primary headers and the second plurality of primary headers is selected from a grouping of primary headers consisting of two, three and four primary headers, to form an exhaust pipe reduction grouping consisting of 4:2:1, 6:2:1 and 8:2:1 exhaust pipes, respectively.

15. A merge collector for directing a flow of exhaust gases from an internal combustion engine, comprising:

a collector flowtube of constant circumference along an entire length thereof, said flowtube comprising:

a substantially oval-shaped collector inlet for coupling with a substantially oval-shaped manifold outlet formed from a plurality of primary headers having discharge portions merged together at a merge angle; and a substantially-round collector outlet for coupling with a substantially-round pipe inlet of a secondary pipe having a diameter greater than a diameter of the primary headers, wherein a transverse cross-sectional area of the collector flowtube from the collector inlet to the collector outlet continuously increases to cause a continuous expansion of the flow of exhaust gases.

16. An exhaust collector system for discharging a flow of exhaust gases from an internal combustion engine, comprising:

a first and a second plurality of primary headers being merged together at a first merge angle into a first and a second substantially oval-shaped manifold outlets, respectively;

a first and a second collector flowtube, each having a constant circumference along an entire length thereof and a substantially oval-shaped collector inlet coupled with a respective first and second manifold outlet;

a third collector flowtube of constant circumference along an entire length thereof and having a substantially oval-shaped third collector inlet and a substantially-round third collector outlet;

wherein the first and second collector flowtubes are merged together at a second merge angle to form a third substantially oval-shaped manifold outlet coupled to the substantially oval-shaped collector inlet of the third collector flowtube; and wherein a flow of an exhaust gas from any primary header, through a respective first or second collector flowtube and into the third collector flowtube does not encounter a reduction in transverse cross-sectional area along the flow path thereof.

17. The exhaust collector system of claim 16, wherein each of the first and second plurality of primary headers is selected from a grouping of primary headers consisting of two, three and four primary headers, to form an exhaust pipe reduction grouping consisting of 4:2:1, 6:2:1 and 8:2:1 exhaust pipes, respectively.

18. The exhaust collector system of claim 16, wherein each of the first and second plurality of primary headers is merged together without expansion of the sidewalls of the primary headers.

19. A merge collector for directing a flow of exhaust gases from an internal combustion engine, comprising:

a first and a second collector flowtubes, each having a constant circumference along an entire length thereof and a substantially oval-shaped collector inlet for coupling with a substantially oval-shaped manifold outlet formed from a plurality of primary headers merged together at a first merge angle;

a third collector flowtube of constant circumference along an entire length thereof and having a substantially oval-shaped third collector inlet and a substantially-round third collector outlet;

wherein the first and second collector flowtubes are merged together at a second merge angle to form a third substantially oval-shaped manifold outlet coupled to the substantially oval-shaped collector inlet of the third collector flowtube; and wherein a transverse cross-sectional area through the merge collector from either first or second collector inlet to the third collector outlet continuously increases to cause a continuous expansion of the flow of exhaust gases.

20. A method of forming an exhaust gas collector system for an internal combustion engine comprising:

obtaining a collector flowtube having a substantially oval-shaped collector inlet, a substantially-round collector outlet and a constant circumference along an entire length thereof;

coupling the collector inlet to a substantially oval-shaped manifold outlet formed from a plurality of primary headers having discharge portions merged together at a merge angle; and coupling the collector outlet to a substantially-round secondary pipe having a pipe inlet diameter greater than a diameter of a primary header, wherein a flow path of the exhaust gas from any primary header, through the collector flowtube and into the secondary pipe does not encounter a reduction in transverse cross-sectional area along the flow path thereof.

21. The method of claim 20, wherein the substantially oval-shaped manifold outlet is formed without expansion of the sidewalls of the primary headers.

* * * * *